US005124010A

United States Patent [19]

Nakao et al.

[11] Patent Number: 5,124,010

[45] Date of Patent: Jun. 23, 1992

[54] CARBON FIBERS HAVING MODIFIED SURFACES AND PROCESS FOR PRODUCING THE SAME

[75] Inventors: Fujio Nakao; Naoki Sugiura, both of Otake, Japan

[73] Assignee: Mitsubishi Rayon Company, Limited, Tokyo, Japan

[21] Appl. No.: 447,857

[22] Filed: Dec. 8, 1989

[30] Foreign Application Priority Data

| | | | |
|---|---|---|---|
| Dec. 12, 1988 | [JP] | Japan | 63-313126 |
| Jan. 25, 1989 | [JP] | Japan | 1-15569 |
| May 11, 1989 | [JP] | Japan | 1-116021 |
| May 18, 1989 | [JP] | Japan | 1-122918 |

[51] Int. Cl.[5] ..... C25F 5/00

[52] U.S. Cl. ..... 204/130; 204/131; 204/132

[58] Field of Search ..... 204/130, 131, 132; 427/113

[56] References Cited

U.S. PATENT DOCUMENTS

| | | | |
|---|---|---|---|
| 3,832,297 | 8/1974 | Paul, Jr. | 204/130 |
| 3,957,716 | 5/1976 | Weldy | 525/524 |
| 4,401,533 | 8/1983 | Saito et al. | 204/130 |
| 4,600,572 | 7/1986 | Hiramatsu et al. | 423/447.2 |
| 4,603,157 | 7/1986 | Asai et al. | 523/440 |
| 4,729,820 | 3/1988 | Mitchell | 204/130 |
| 4,735,693 | 4/1988 | Asai et al. | 204/1 T |
| 4,749,451 | 6/1988 | Naarmann | 204/180.4 |
| 4,814,157 | 3/1989 | Uno et al. | 423/447.2 |
| 4,839,006 | 6/1989 | Nakao et al. | 204/130 |
| 4,867,852 | 9/1989 | Nakao et al. | 204/130 |

FOREIGN PATENT DOCUMENTS

| | | | |
|---|---|---|---|
| 234432 | 9/1987 | European Pat. Off. . | |
| 273806 | 7/1988 | European Pat. Off. . | |
| 2141171 | 6/1987 | Japan | 204/130 |
| 62-149964 | 7/1987 | Japan | 204/130 |
| 1433712 | 4/1976 | United Kingdom . | |

OTHER PUBLICATIONS

Furuhashi et al., Surface Treatment of Carbon Fibers, Oct. 2, 1985, CA 104(14):110823u.

Pure and Appl. Chem., vol. 52, pp. 1929–1937, 1980, R. V. Subramanian, "Electrochemical Polymerization and Deposition on Carbon Fibers".

*Primary Examiner*—John Niebling
*Assistant Examiner*—Arun S. Phasge
*Attorney, Agent, or Firm*—Oblon, Spivak, McClelland, Maier and Neustadt

[57] ABSTRACT

A process is disclosed for producing carbon fibers with modified surfaces by electrolytic treatment. In the process, electric current is passed between carbon fibers and a counter electrode in an electrolytic solution to which an aromatic compound having at least one hydroxyl group and/or amino group is added.

19 Claims, 1 Drawing Sheet

CARBON FIBERS HAVING MODIFIED SURFACES AND PROCESS FOR PRODUCING THE SAME

BACKGROUND OF THE INVENTION

1. Field of the Invention

The present invention relates to a process for producing carbon fibers having modified surfaces, and more particularly to a process for producing carbon fibers having modified surfaces which are excellent in adhesion to matrix resins. The present invention further relates to carbon fibers having such modified surfaces.

2. Description of the Prior Art

Since composite materials using carbon fibers as reinforcement are light in weight and excellent in strength and elastic modulus, they are used in a variety of fields including parts for sports and leisure goods or materials for aerospace vehicles. However, since conventional carbon fibers used as reinforcement for composite materials are not necessarily satisfactory from the point of view of adhesion to the matrix resins, it is known to activate the surface by oxidizing with a chemical agent, in an oxidizing gaseous phase, or by electrolytic oxidizing treatment, thereby improving the adhesion of the carbon fibers to the matrix resins. Electrolyte oxidation is considered most practical from the viewpoint of its good operatability and ease reaction control.

In electrolytic oxidizing treatment, various electrolytes have been studied.

For example, U.S. Pat. No. 4,401,533 discloses a process wherein electrolytic oxidation is carried out using a carbon fiber as an anode in an aqueous sulfuric acid solution under the specified range of electric current, voltage and treating time.

U.S. Pat. No. 3,832,297 discloses that an ammonium compound is used as an electrolyte, electrolytic oxidation is carried out using a carbon fiber as an anode, and the compound decomposes at a temperature of lower than 250° C. and does not remain on the fiber surface.

U.S. Pat. No. 4,867,852 discloses a process wherein after electrolytic oxidation is carried out by using an ammonium compound as an electrolyte and a carbon fiber as an anode, the carbon fiber is subjected to ultrasonic cleaning.

U.S. Pat. No. 4,600,572 discloses that when a carbon fiber is electrolytically oxidized in nitric acid and then subjected to an inactivation treatment, a carbon fiber having a high strength and excellent adhesion to resins can be produced.

Further, since sufficient surface treatment cannot be effected by the use of one electrolyte, performing of a two-stage electrolytic treatment is suggested in U.S. Pat. No. 4,839,006. However, in the prior technique, a satisfactory surface treatment effect cannot be obtained for high-modulus carbon fibers of a modulus of higher than 30 t/mm$^2$.

U.S. Pat. Nos. 4,814,157, and 4,729,820 disclose processes wherein nitrogen functional groups are introduced onto the carbon fiber surface by a two-stage surface treatment.

Surface treatments other than oxidation, are known. For instance it is known to attach certain polymers to the surface of a carbon fiber by electrolytic polymerization as disclosed by R. V. Subramanian in Pure & Appl. Chem., Vol. 52, pp. 1929 to 1937 (1980).

Year by year, however, the demand for enhancing the performance of carbon fibers is increasing. In particular, the development of carbon fiber for aircraft has been directed to make high-strength and high-modulus carbon fiber, and recently, intermediate modulus carbon fiber having a modulus of about 30 t/mm$^2$ is prevalent. On the other hand, the development of carbon fiber for the application to sports and leisure goods has also been directed to prepare high modulus carbon fiber having a modulus of about 45 t/mm$^2$, and good composite properties has also been developed. However, as the modulus of the carbon fiber increases, the surface of carbon fiber becomes more inactive, and the interfacial bonding strength between the fiber and the matrix resin is reduced. Therefore, the conventional surface treatment techniques for carbon fiber are insufficient, and a surface treatment method of high-modulus carbon fiber has not yet been developed for making the composite performance, particularly ILSS (interlaminar shear strength), TS ⊥ (transverse tensile strength), and FS ⊥ (transverse flexural strength) satisfactory. One known surface treatment of carbon fibers involves introducing oxygen or nitrogen functional groups onto the surface, or attaching polymer to the surface of a carbon fiber by electrolytic polymerization. However, since it is considered that oxygen or nitrogen functional groups are introduced only on the edge of the graphite crystal on the surface of the carbon fiber, in the case of high-modulus carbon fiber wherein he graphite crystals are large, defects exist which is limit the introduction. Moreover, if the level of the electrolytic oxidation treatment is excessively elevated, the strength of the carbon fiber itself is lowered.

In the process wherein a polymer is attached to the surface of a carbon fiber by electrolytic polymerization, no polymer has been found that can make the interfacial bonding strength between the carbon fiber and the matrix resin sufficiently high, and an industrially or commercially optimum technique has not yet been discovered.

Taking these things into consideration, studies have been made, and a process has been found wherein oxygen and nitrogen functional groups are introduced onto a carbon fiber and electrolytic polymerization is effected.

SUMMARY OF THE INVENTION

An object of the present invention is to provide carbon fibers excellent in adhesion to matrix resins which fibers may exhibit improved composite performance. Another object of the present invention is to provide a novel process for producing such carbon fibers.

The above objects of the present invention can be achieved by an electrolytic treatment of carbon fibers in an electrolyte solution to which an aromatic compound having one or more of hydroxyl groups and/or amino groups is added as a monomer.

BRIEF DESCRIPTION OF THE DRAWINGS

The figures are photographs taken by an electron microscope showing the surfaces of carbon fibers; wherein.

DETAILED DESCRIPTION OF THE PREFERRED EMBODIMENTS

Figure 1:
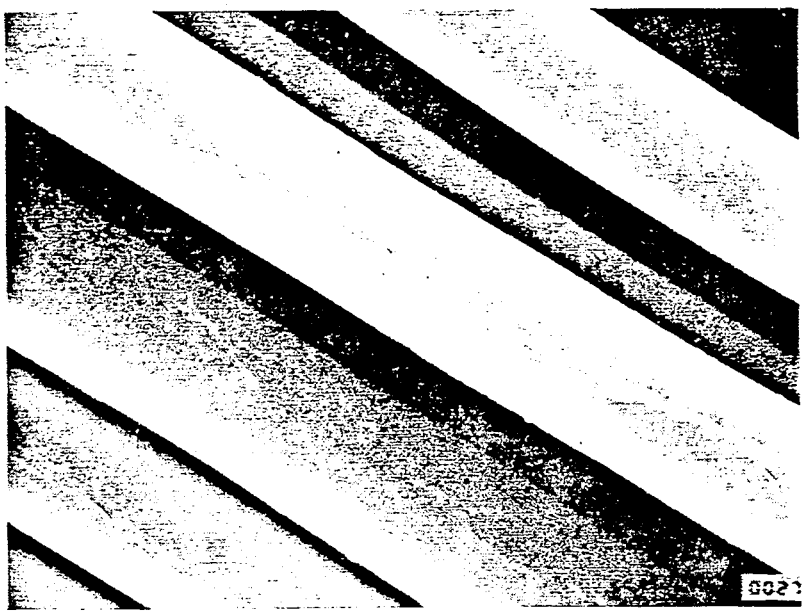
FIG. 1 shows the surfaces of high-modulus carbon fibers prepared in Example 1.

In an electrolytical treatment of the present invention, an aromatic compound having at least one hydroxyl group or amino group, or at least one hydroxyl group and amino group is added to an electrolyte solution.

The aromatic compound having one or more hydroxyl groups can be represented by the general formula:

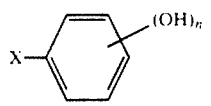

wherein X represents a hydrogen atom, an alkyl group, an aryl group, an alkoxy group, a carboxyl group, a vinyl group or an alkylene group having a carbon-carbon double bond, and n is a number of 1 to 4. Examples of suitable compound include phenol, cresols, hydroxybenzene, hydroxyanisoles, hydroxyamphetamines, hydroxybenzaldehydes, hydroxybenzoic acids, hydroxybutylanilides, dihydroxydiphenylmethanes, dihydroxybenzophenones and dihydroxybiphenyls.

The aromatic compound having one or more amino groups can be represented by the general formula:

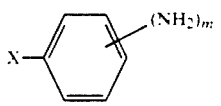

wherein X represents a hydrogen atom, an alkyl group, an aryl group, an alkoxy group, a carboxyl group, a vinyl group or an alkylene group having a carbon-carbon double bond, and m is a number of 1 to 4. Examples of suitable compounds include aniline, diaminobenzenes, aminobenzoic acids, ethylaniline, diaminotoluenes, aminoanisoles, diaminodiphenylmethanes, diaminobenzophenones and diaminobiphenyls.

Aromatic compounds having one or more hydroxyl groups and one or more amino groups can be represented by the general formula:

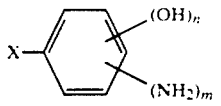

wherein X represents a hydrogen atom, an alkyl group, an aryl group, an alkoxy group, a carboxyl group, a vinyl group or an alkylene group having a carbon-carbon double bond, and m and n each are a number of 1 to 4. Exemplary compounds having both hydroxyl and amino groups include aminophenols, diaminophenols, dihydroxyanilines and aminosalicylic acids.

Particularly, for example, phenol, aniline, o-, m- or p-aminophenol, o- or m-dihydroxybenzene, o-, m- or p-diaminobenzene, and p-aminosalicylic acid are preferable, which may be used alone or as a mixture of two or more of them.

For purpose of the present invention, the term "carbon fibers" is intended to include not only carbon fibers but also graphite fibers. The carbon fibers of the present invention also include acrylonitrile polymer based carbon fibers, cellulose based carbon fibers, pitch based carbon fibers and so-called vapor phase grown carbon fibers.

The concentration of the aromatic compound, that is a monomer from which a polymer will be formed by electrolytic polymerization, in the electrolyte solution is 0.01 to 15% by weight, preferably 0.1 to 10% by weight. If the concentration is lower than 0.01% by weight, the electro-deposition of the polymer by electrolytic polymerization to coat the carbon fiber surfaces is insufficient.

The electrolyte includes such inorganic electrolytes as nitric acid, phosphoric acid, sulfuric acid, sodium nitrate, sodium primary phosphate, sodium secondary phosphate, sodium tertiary phosphate, sodium sulfate, sodium hydroxide, potassium hydroxide, and such ammonium salts as ammonium carbonate, ammonium hydrogencarbonate, ammonium primary phosphate, ammonium secondary phosphate, ammonium tertiary phosphate, ammonium nitrate, ammonium sulfate, and ammonium carbamate, which may be used as a mixture of two or more of them.

Although the optimum value of the quantity of electricity for the electrolytic treatment will vary depending on the composition of the electrolytic solution, such as the type and concentration of the solvent, electrolyte, and the monomer (aromatic compound), the quantity of electricity is 5 to 15,000 coulombs/g, preferably 5 to 1,000 coulombs/g.

The surface treating system may be a batch system or a continuous system.

For sending electric current, conventional methods can be used. A method can also be used wherein electric current is passed to carbon fibers through a conductive roller. The temperature of the solution used for the treatment is in the range of 0° to 100° C, and the treating time in the electrolytic solution is from several seconds to several tens of minutes, preferably from 5 seconds to 5 minutes. The electrolytic solution may flow through the reactor to enhance cleaning Alternatively, bubbling with an inert gas or ultrasonic vibrations can be applied to the electrolytic solution.

In order to stick the aromatic compound by electrolytic polymerization firmly onto the surface of carbon fibers, the carbon fibers may be subjected to a previous oxidation treatment, or they may be oxidized simultaneously with the electrolytic treatment of the present invention. This is because the oxygen functional groups introduced onto the carbon fiber surfaces by the oxidization treatment have some influence on electro-deposition of the polymer at the time of the electrolytic treatment. Further, the amount of the electro-deposition of the polymer onto carbon fibers increases with increasing of the amount of oxygen functional groups by the previous oxidization treatment.

The electrolytic treatment of the present invention is carried out more preferably in an aqueous solution than in an organic solvent from the view point of safety in commercial operation.

When the electrolytic treatment is carried out using the carbon fibers as an anode, the electrolytic polymerization of the aromatic compound having one or more of hydroxyl groups and/or amino groups proceeds, and at the same time the carbon fibers can be oxidized.

With respect to the electrolyte used in the electrolysis, it is required to select the most suitable one depending on the structure of the carbon fibers to be treated.

As a result of the study, it has been found that the properties of the surface of the carbon fibers are greatly influenced by the type of electrolyte used in the electrolytic oxidation. When the treatment is carried out using an aqueous solution having a pH not higher than 7 and containing an acid or neutral salt electrolyte such as nitric acid, phosphoric acid, sodium nitrate, sodium primary phosphate, sodium secondary phosphate, sodium tertiary phosphate, ammonium primary phosphate, ammonium secondary phosphate, ammonium tertiary phosphate, ammonium nitrate, and ammonium sulfate, it is more or less easy to introduce oxygen to the surfaces of the carbon fibers more or less. However, if the treating level for the carbon fibers having a modulus of less than 40 t/mm$^2$ is elevated too much, the composite performance that serves as an index of the interface strength such as ILSS, FS ⊥, and TS ⊥ will be lowered. This is believed to be a result of the formation of a weak boundary layer on the surfaces of the carbon fibers by the surface treatment.

On the other hand, if the treatment is carried out by using an aqueous solution having a pH of 7 or over and containing ammonium salt of carbonic acid or an inorganic alkali metal hydroxide such as ammonium carbonate, ammonium bicarbonate, sodium hydroxide and potassium hydroxide, it has been found that smooth etching can be effected although the introduced amount of oxygen is small. However, it has been shown that as the modulus of the carbon fibers increases, the introduced amount of oxygen tends to be lower. Even if the treatment level is elevated for carbon fibers having a modulus of higher than 40 t/mm$^2$, it is impossible to introduce enough oxygen.

Therefore, after the electrolytic treatment using the carbon fibers as an anode, an inorganic alkali metal hydroxide or an ammonium salt of carbonic acid can be used for the carbon fibers having a modulus of lower than 40 t/mm$^2$, and an inorganic acidic or neutral salt electrolyte can be used, for the carbon fibers having a modulus of 40 t/mm$^2$ or over, as an electrolyte which will introduce an enough amount of oxygen functional groups onto the carbon fiber surfaces, but will not cause formation of a weak boundary layer on the surface.

Thus, in the present invention, an aqueous solution of an inorganic alkali metal hydroxide, or an ammonium salt of carbonic acid having a pH of 7 or over can be used for the carbon fibers having a modulus of lower than 40 t/mm$^2$, or an aqueous solution of an inorganic acidic electrolyte or neutral salt electrolyte having a pH of 7 or below is used for carbon fibers having a modulus of 40 t/mm$^2$ or over in the presence of the aromatic compound when the electrolytic treatment can be carried out by passing an electric current between the carbon fibers serving as an anode and the counter electrode.

Carbon fibers which have been preoxidized may be used. That is, the purpose of the present invention can also be achieved by electro-deposition treatment of the carbon fibers, which have been oxidized so that the oxygen functional group content ($O_{1S}/C_{1S}$) of the carbon fiber surfaces determined by the X-ray photoelectron spectroscopy becomes 0.07 or over in a solution containing an aromatic compound having one or more of hydroxyl groups or amino groups.

Suitable oxidizing treatments include, electrolytic oxidation, ozone oxidation, chemical agent oxidation using an oxidizing agent such as nitric acid, air oxidation, and plasma oxidation can be used. Of these electrolytic oxidation is most easily used on a commercial scale.

The object of the present invention can also be achieved by subjecting carbon fibers to a first electrolytic treatment using the carbon fibers as anode in an aqueous solution of an inorganic acidic electrolyte or an aqueous solution of a neutral salt electrolyte having a pH of 7 or below so that the oxygen functional content ($O_{1S}/O_{1S}$) of the carbon fiber surfaces determined by the X-ray photoelectron spectroscopy becomes 0.07 or over, and then subjecting the fiber to a second electrolytic treatment by passing an electric current between the carbon fibers and the counter electrode in a solution of an inorganic alkali metal hydroxide or an ammonium salt of carbonic acid at a pH of 7 or over containing the aromatic compound.

In this process, the first electrolytic treatment introduces oxygen, and the second electrolytic treatment removes the weak boundary layer on the surfaces and at the same time allows electrolytic polymerization of the aromatic compound to adhere the polymer firmly onto the carbon fiber surfaces.

When the carbon fibers obtained in this manner are used in a composite material, there is no particular limitation on the matrix resin used therein. Suitable matrix resins include the thermosetting resins, for example, epoxy resin, imide resins, or the unsaturated polyester resins, or the thermoplastic resins, for example, polyamides, polyesters, polysulfones, polyether ether ketones, polyether imides, polyether sulfones, polyacetal resins, polypropylenes, ABS resins, and polycarbonates.

The interfacial bonding strength between the carbon fibers treated according to the present invention and the matrix resin is high, and it is also possible to obtain carbon fibers having an interfacial shear strength $\tau$ of higher than 3.6 kg/mm$^2$ measured by the single filament adhesion test using an epoxy resin. The shear strength $\tau$ is an index of the interfacial bonding strength between the carbon fibers and matrix resin.

The value of the interfacial shear strength $\tau$ of 3.6 kg/mm$^2$ cannot be obtained only by oxidation of carbon fibers, but can be obtained by the treatment of the present invention. Thus, according to the present invention, carbon fibers excellent which possess adhesion in a matrix resin can easily prepared.

The present invention is also directed to carbon fibers having a modulus of lower than 40 t/mm$^2$ which surfaces have been modified, wherein the $i_{pa}$ value determined by the electrochemical determination method (cyclic voltammetry) is in the range of 0.6 to 1.4 $\mu$A/cm$^2$, and the oxygen functional group content ($O_{1S}/C_{1S}$) and the nitrogen functional group content ($N_{1S}/C_{1S}$) of the carbon fiber surfaces determined by the X-ray photoelectron spectroscopy are in the ranges of 0.10 to 0.24, and 0.01 to 0.20, respectively.

The $i_{pa}$ value obtained by the electrochemical determination (cyclic voltammetry) is in the range of 0.08 to 0.6 $\mu$A/cm$^2$ in the case of carbon fibers obtained by conventional surface treatment, and in order to obtain carbon fibers having high bonding strength to resins, it is considered that the range is preferably 0.08 to 0.4 $\mu$A/cm$^2$. However, in a preferable embodiment of the present invention, the $i_{pa}$ value of higher than 0.6 $\mu$A/cm$^2$ can be obtained. This is because the present invention effects introduction, onto carbon fiber surfaces, of not only the oxygen functional groups but also the nitrogen functional groups derived from the aromatic compound and electrolyte and effects electro-deposition of a polymer by the electrolytic polymerization on the surfaces of the carbon fibers and thus effects surface coating of the carbon fibers. In other words, on account of the electro-deposition of the polymer and coating of the carbon fiber surfaces, the $i_{pa}$ value in the electrochemical determination (cyclic voltammetry) is raised compared with that of conventional treatment. Accordingly, if the $i_{pa}$ value is lower than 0.6 $\mu A/cm^2$, the electro-deposition and the surface coating are not sufficient, and carbon fibers excellent in adhesion cannot be obtained. On the other hand, if the $i_{pa}$ value exceeds 1.4 $\mu A/cm^2$, wettability with resins and strength of the coating layer will decrease, thereby resulting in lower adhesion between the carbon fibers and the matrix.

The $O_{1S}/C_{1S}$ or $N_{1S}/C_{1S}$ of carbon fibers determined by the X-ray photoelectron spectroscopy is a suitable index indicating the oxygen functional group content or the nitrogen functional group content of the carbon fiber surfaces, and the greater the value of the $O_{1S}/C_{1S}$ or $N_{1S}/C_{1S}$ is, the higher is the oxygen functional group content or the nitrogen functional group content.

It be preferable that the $O_{1S}/C_{1S}$ is in the range of 0.10 to 0.24. If the $O_{1S}/C_{1S}$ is lower than 0.10, the adhesion between the carbon fibers and the resin becomes weaker due to the shortage of the oxygen content of the carbon fiber surfaces. On the other hand, if the $O_{1S}/C_{1S}$ exceeds 0.24, it is considered that the removal of the surface weak boundary layer in the second electrolytic treatment will be insufficient. The weaker boundary layer remaining on the carbon fiber surface causes lower adhesion between the carbon fibers and the resin.

It be preferable that the $N_{1S}/C_{1S}$ is in the range of 0.01 to 0.20, more preferably from 0.03 to 0.20. If the $N_{1S}/C_{1S}$ is lower than 0.01, the introduction of the nitrogen functional groups or the electro-deposition of the polymer and the coating of the carbon fiber surfaces will not be sufficient, and carbon fibers having excellent adhesion cannot be obtained. On the other hand, if the $N_{1S}/C_{1S}$ exceeds 0.20, the quantities of the electro-deposition of the polymer and the coating of the carbon fiber surfaces will become excessive, wettability with the resin and the strength of the coating layer will decrease, and the adhesion between the carbon fibers and the matrix will be lower.

The present invention is also directed to high-modulus carbon fibers having a modulus of 40 $t/mm^2$ or higher which surfaces have been modified, wherein the $i_{pa}$ value determined by the electrochemical determination method (cyclic voltammetry) is in the range of 0.8 to 3.5 $\mu A/cm^2$, and the oxygen functional group content ($O_{1S}/C_{1S}$) and the nitrogen functional group content ($N_{1S}/C_{1S}$) of the carbon fiber surfaces determined by the X-ray photoelectron spectroscopy are in the ranges of 0.10 to 0.30, and 0.03 to 0.25, respectively.

In carbon fibers having a modulus of 40 $t/mm^2$ or higher, the graphite crystals are larger than those of carbon fibers having a modulus of lower than 40 $t/mm^2$, and the surface of carbon fibers having a modulus of 40 $t/mm^2$ or higher is more inactive than that of carbon fibers having a modulus of lower than 40 $t/mm^2$. Therefore, in carbon fibers having a modulus of 40 $t/mm^2$ or higher, it is required to introduce the functional groups on the surface more than that of carbon fibers having a modulus of lower than 40 $t/mm^2$.

That is, in carbon fibers having a modulus of 40 $t/mm^2$ or higher, the $i_{pa}$ must be 0.8 $\mu A/cm^2$ or over. In other words, on account of the electro-deposition of the polymer and surface coating of the high-modulus carbon fiber surfaces, the $i_{pa}$ value in the electrochemical determination method (cyclic voltammetry) is high in comparison with that of the usual treatment. Accordingly, if the $i_{pa}$ value is lower than 0.8 $\mu A/cm^2$, the electro-deposition and the surface coating are not sufficient, and high-modulus carbon fibers which are excellent in adhesion cannot be obtained. On the other hand, if the $i_{pa}$ value exceeds 3.5 $\mu A/cm^2$, the wettability with resins and strength of the coating layer will decrease, thereby resulting in lower adhesion between the high-modulus carbon fibers and the matrix.

It is preferable for high-modulus carbon fibers that the $O_{1S}/C_{1S}$ be in the range of 0.10 to 0.30. If the $O_{1S}/C_{1S}$ is lower than 0.10, the adhesion between the high-modulus carbon fibers and the resin becomes weak due to the shortage of the oxygen content of the high-modulus carbon fiber surfaces. On the other hand, if the $O_{1S}/C_{1S}$ exceeds 0.30, it indicates that the degree of the surface treatment is excessive.

It is preferable for high-modulus carbon fibers that the $N_{1S}/C_{1S}$ be in the range of 0.03 to 0.25. If the $N_{1S}/C_{1S}$ is lower than 0.03, the introduction of the nitrogen functional groups, the electro-deposition and the surface coating of the polymer onto the high-modulus carbon fiber surfaces are will not sufficient, and thus carbon fibers excellent in adhesion cannot be obtained. On the other hand, if the $N_{1S}/C_{1S}$ exceeds 0.25, the quantities of the electro-deposition and the surface coating of the polymer become excessive, and wettability with the resin and strength of the coating layer will decrease, which will result in lower adhesion between the high-modulus carbon fibers and the matrix.

The carbon fibers serving as the anode may be subjected to a two stage process wherein in the first stage they are subjected to a first electrolytic treatment in an aqueous solution of a neutral salt electrolyte or an inorganic acidic electrolyte of a pH of 7 or below, and then are subjected to a second electrolytic treatment in an electrolytic solution containing an ammonium salt of carbonic acid or an inorganic alkali metal hydroxide and having a pH of 7 or over, wherein the solution also contains the aromatic compound which is electrolytically polymerizable in the solution.

In this case, it is preferred that the quantity of the electricity used in the first electrolytic treatment be more than 5 coulombs/g, and the quantity of the electricity used in the second electrolytic treatment be more than 90 coulomb/g.

EXAMPLES

The present invention will now be further described specifically with reference to the following Examples. It should be understood, however, that the invention is not limited to the specific details set forth in the examples. Several characteristics in the examples were measured by the methods as explained as follows:

(1) The $i_{pa}$ value was measured by a cyclic voltammetry method described in U.S. Pat. Nos. 4,603,157 and 4,735,693 as follows:

The pH of the electrolytic solution used was adjusted to 3 by using 5% aqueous phosphoric acid solution, and nitrogen was bubbled into the electrolytic solution to eliminate the effect of the dissolved oxygen. The sample carbon fibers were used as one electrode, and were immersed in the electrolytic solution, and on the other hand, as the counter electrode, a platinum electrode having a sufficient surface area was used, and, as a reference electrode, an Ag/AgCl electrode was used. The form of the sample was a 12,000-filament tow of 50 mm in length. The scanning range of the electric potential applied between the carbon fiber electrode and the platinum electrode was −0.2 V to +0.8 V, and the scanning speed was 2.0 mV/sec. The electric current-/voltage curve was drawn by an X-Y recorder, the sweeping was effected three times or more, and when the curve became stable, the current intensity i was read off at a standard potential of +0.4 V against Ag/AgCl reference electrode, and the $i_{pa}$ was calculated according to the following equation:

$$i_{pa} = i(\mu A)/\text{sample length (cm)} \cdot \left( \frac{4\pi \cdot \text{weight (g/cm)} \cdot \text{number of filaments}}{\text{density (g/cm}^3)} \right)^{\frac{1}{2}}$$

As will be understood from the equation above, the $i_{pa}$ was determined by dividing the electric current intensity i by the apparent surface area calculated from the sample length, the weight, and the sample density obtained according to the method described in JIS-R-7601. The measurement was carried out by using a Voltammetry Analyzer P-1000 model manufactured by Yanagimoto Seisakusho Co., Ltd.

(2) The measurement of the oxygen concentration ($O_{1S}/C_{1S}$ atomicity ratio) and the nitrogen concentration ($N_{1S}/C_{1S}$ atomicity ratio) of the carbon fiber surfaces by the X-ray photoelectron spectroscopy was carried out in such a manner that when the MgKa ray was used as X-ray source by using an EXCA apparatus, ESCALABMK II model manufactured by VG COMPANY, $O_{1S}/C_{1S}$ and $N_{1S}/C_{1S}$ were calculated as atomicity ratios using the ASF value (0.205, 0.630, and 0.380) from the signal intensities of $C_{1S}$, $O_{1S}$, and $N_{1S}$.

(3) The measurement of the interfacial shear strength ($\tau$) was carried out as follows:

A sample piece was prepared by embedding a continuous single filament in matrix resin such as epoxy resin (consisting of 100 parts of Epicoat manufactured by Yuka-Shell Inc., 90 parts of Kayahard MCD manufactured by Nippon Kayaku Co., Ltd. and 3 parts of N,N-dimethylbenzylamine). By applying a predetermined pulling strain or higher to the sample piece, the embedded filament was broken at many points. The lengths of the broken fibers were measured to find the average broken length ($\bar{l}$), and the critical fiber length (lc) was determined according to the equation:

$$lc = \frac{4}{3}\bar{l}$$

By the single fiber tensile strength test, the strength distribution of the carbon fibers was found, and the Weibull distribution was applied thereto to find the Weibull parameter $m.\sigma_0$. From the Weibull parameter $m.\sigma_0$, the average breaking strength $\sigma_f$ at the critical fiber length (lc) was calculated, and from the equation, $\tau = \sigma_f d/2lc$, wherein d was the diameter of the carbon fibers, the interfacial shear strength ($\tau$) was determined.

(4) The strand strength and the modulus were measured by the method described in JIS-R 7601.

(5) The ILSS was determined in accordance with ASTM D-2344 by carrying out the short beam test using a test piece having a width of 10 mm, a thickness of 4 mm, and a length of 20 mm with the span length being 10 mm. #340 epoxy resin manufactured by Mitsubishi Rayon Co., Ltd. was used as the matrix resin.

EXAMPLES 1 TO 10 AND COMPARATIVE EXAMPLES 1 TO 4

An acrylonitrile/methacrylic acid copolymer (weight ratio: 98 / 2) was dissolved in dimethylformamide to prepare a dope with solid concentration of 26% by weight. The dope was subjected to filtrations with filters of 10-μm and 3-μm pore size, respectively, and subjected to wet spinning, then 4.5 times stretch was effected on the resultant filaments in hot water followed by washing with water and drying, and then 1.7 times stretch was further effected on the filaments under dry condition at 170° C. to obtain a precursor having 12,000 filaments of 0.9 deniers.

The precursor was passed through a hot-air circulating type furnace at 220° to 260° C. for 60 minutes to obtain flame resistant fibers with a density of 1.35 g/cm³. When the flame resisting treatment explained above was effected, 15% stretching was carried out on the fibers.

Then, the flame resistant fibers were passed through a first carbonization furnace having a temperature gradient of 300° to 600° C. in an atmosphere of pure $N_2$ while applying 8% stretch thereto.

Further, they were heat-treated for 2 minutes in a second carbonization furnace having a maximum temperature of 1,800° C. in the same atmosphere as that of the first carbonization furnace under a tension of 400 mg/denier to obtain carbon fibers. The carbon fibers had a strand strength of 550 kg/mm² and a strand modulus of 34.8 t/mm². Using the carbon fibers as anode, an electric current was passed in a first bath of a 5% aqueous phosphoric acid solution having a pH of 1 at 30° C., and then p-phenylenediamine (1.0% by weight) was added to a second bath of a 5% aqueous ammonium bicarbonate solution having a pH of 7.5 at a temperature of 30° C. and an electric current was passed through the second bath using the carbon fibers as anode. The quantity of the electricity was varied in the first and and the second electrolytic treatment. The treating speed in the treatments was 20 m/hour.

Figure 2:
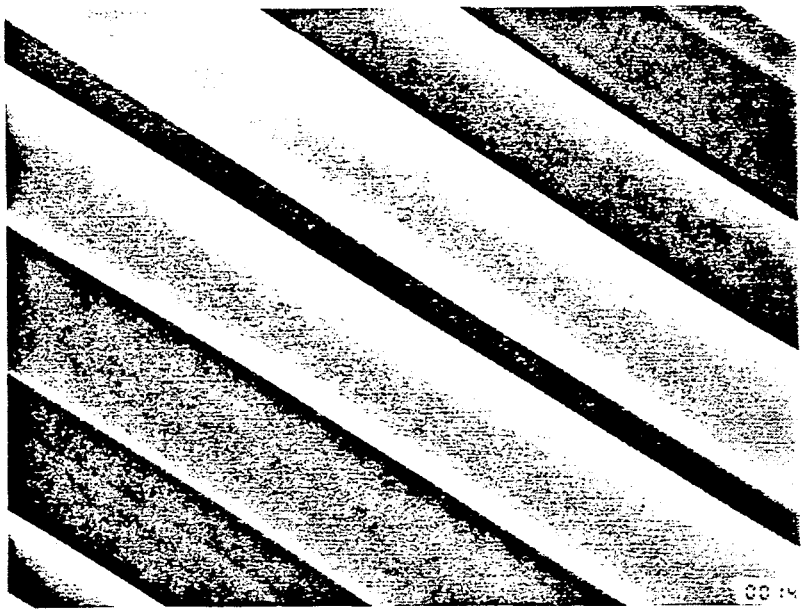
FIG. 2 shows the surfaces of high-modulus carbon fibers prepared in Example 6.

The results are shown in Table 1. Table 1 also shows the results of Comparative Examples. FIG. 1 shows a photograph of the carbon fiber surface obtained in Example 1 taken by a scanning electron microscope, and FIG. 2 shows a photograph of the carbon fiber surface obtained in Example 6. In both Figures, magnification of the photographs was 3,000 X. From FIG. 1, it could be clearly understood that the surface of the carbon fibers obtained according to the Example 1 has an electro-deposition or a surface coating of a polymer. On the other hand, the surface of the carbon fibers obtained in Example 6 is smooth, and an electro-deposition or surface coating of a polymer is hardly recognized.

From these results, it can be understood that carbon fibers excellent in adhesion, for example, having an interfacial shear strength ($\tau$) with epoxy resins of higher than 3.6 kg/mm² can be obtained.

TABLE 1

| No | First electrolytic treatment: Electrolytic solution | First electrolytic treatment: Quantity of electricity (coulombs/g) | Second electrolytic treatment: Electrolytic solution | Second electrolytic treatment: Quantity of electricity (coulombs/g) | $i_{pa}$ ($\mu A/cm^2$) | O/C | N/C | $\tau$ ($kg/mm^2$) |
|---|---|---|---|---|---|---|---|---|
| Example 1 | Phosphoric acid (5%) (30° C.) | 22 | Ammonium bicarbonate (5%) p-phenylenediamine (1%) (30° C.) | 260 | 0.60 | 0.16 | 0.03 | 4.4 |
| Example 2 | Phosphoric acid (5%) (30° C.) | 22 | Ammonium bicarbonate (5%) p-phenylenediamine (1%) (30° C.) | 460 | 1.00 | 0.15 | 0.03 | 5.6 |
| Example 3 | Phosphoric acid (5%) (30° C.) | 5 | Ammonium bicarbonate (5%) p-phenylenediamine (1%) (30° C.) | 260 | 0.60 | 0.14 | 0.02 | 3.6 |
| Example 4 | Phosphoric acid (5%) (30° C.) | 5 | Ammonium bicarbonate (5%) p-phenylenediamine (1%) (30° C.) | 460 | 1.02 | 0.16 | 0.03 | 4.2 |
| Example 5 | Phosphoric acid (5%) (30° C.) | 22 | Ammonium bicarbonate (5%) p-phenylenediamine (1%) (30° C.) | 33 | 0.48 | 0.15 | Undetectable | 1.5 |
| Example 6 | Phosphoric acid (5%) (30° C.) | 22 | Ammonium bicarbonate (5%) p-phenylenediamine (1%) (30° C.) | 65 | 0.58 | 0.16 | Undetectable | 2.2 |
| Example 7 | Phosphoric acid (5%) (30° C.) | 5 | Ammonium bicarbonate (5%) p-phenylenediamine (1%) (30° C.) | 130 | 0.43 | 0.13 | 0.03 | 2.9 |
| Example 8 | Without | — | Ammonium bicarbonate (5%) p-phenylenediamine (1%) (30° C.) | 130 | 0.53 | 0.15 | 0.05 | 2.2 |
| Comparative example 1 | Phosphoric acid (5%) (30° C.) | 22 | Ammonium bicarbonate (5%) (30° C.) | 90 | 0.18 | 0.10 | 0.05 | 3.3 |
| Example 9 | Phosphoric acid (5%) (30° C.) | 22 | Sodium nitrate (5%) p-phenylenediamine (1%) (30° C.) | 22 | 0.68 | 0.26 | 0.10 | 2.8 |
| Example 10 | Ammonium bicarbonate (5%) (30° C.) | 80 | Ammonium bicarbonate (5%) p-phenylenediamine (1%) (30° C.) | 130 | 0.54 | 0.14 | 0.02 | 2.2 |
| Comparative Example 2 | Without | — | Without | — | 0.01 | 0.04 | Undetectable | 1.1 |
| Comparative Example 3 | Phosphoric acid (5%) (30° C.) | 22 | Without | — | 0.42 | 0.21 | 0.01 | 2.5 |
| Comparative Example 4 | Ammonium bicarbonate (5%) (30° C.) | 90 | Without | — | 0.10 | 0.07 | 0.03 | 2.8 |

EXAMPLES 11 TO 13 AND COMPARATIVE EXAMPLES 5 TO 10

Carbon fibers obtained in the same manner as in Example 1 were used, and the interfacial shear strength ($\tau$) with a polycarbonate resin, a polyetherimide resin (Ultem 1000 manufactured by General Electric), and a polypropylene resin was measured, respectively. The results are shown in Table 2. The results of Comparative Examples are also shown in Table 2.

TABLE 2

| No. | First treatment: Electrolytic solution | First treatment: Quantity of electricity (coulombs/g) | Second treatment: Electrolytic solution | Second treatment: Quantity of electricity (coulombs/g) | $\tau$ ($kg/mm^2$) |
|---|---|---|---|---|---|
| Example 11 | Phosphoric acid (5%) (30° C.) | 22 | Ammonium bicarbonate (5%) p-phenylenediamine (1%) (30° C.) | 460 | 4.0 |
| Comparative Example 5 | Phosphoric acid (5%) (30° C.) | 22 | Ammonium bicarbonate (5%) (30° C.) | 90 | 2.6 |
| Comparative Example 6 | Without | — | Without | — | 1.0 |
| Example 12 | Phosphoric acid (5%) (30° C.) | 22 | Ammonium bicarbonate (5%) p-phenylenediamine (1%) (30° C.) | 460 | 6.5 |
| Comparative Example 7 | Phosphoric acid (5%) (30° C.) | 22 | Ammonium bicarbonate (5%) (30° C.) | 90 | 4.9 |
| Comparative Example 8 | Without | — | Without | — | 1.9 |
| Example 13 | Phosphoric acid (5%) (30° C.) | 22 | Ammonium bicarbonate (5%) p-phenylenediamine (1%) (30° C.) | 460 | 0.8 |
| Comparative | Phosphoric acid (5%) (30° C.) | 22 | Ammonium bicarbonate | 90 | 0.6 |

TABLE 2-continued

| No | First treatment: Electrolytic solution | First treatment: Quantity of electricity (coulombs/g) | Second treatment: Electrolytic solution | Second treatment: Quantity of electricity (coulombs/g) | τ (kg/mm²) |
|---|---|---|---|---|---|
| Example 9 | | | (5%) (30° C.) | | |
| Comparative Example 10 | Without | — | Without | — | 0.3 |

Example 11, Comparative Examples 5, 6: Polycarbonate resin
Example 12, Comparative Examples 7, 8: Polyeterimide resin
Example 13, Comparative Examples 9, 10: Polypropyrene resin

EXAMPLES 14 TO 19 AND COMPARATIVE EXAMPLES 11 AND 12

An acrylonitrile/methacrylic acid copolymer (weight ratio: 98 / 2) was dissolved in dimethylformamide to prepare a dope with solid concentration of 26% by weight. The dope was subjected to filtrations with filters of 10-μm and 3-μm pore size, respectively, and subjected to wet spinning, then 4.5 times stretch was effected on the resultant filaments in hot water, followed by washing with water and drying, and then further 1.7 times stretch was effected on the filaments under dry condition at 170° C. to obtain a precursor having 12,000 filaments of 0.9 deniers.

The precursor was passed through a hot-air circulating type furnace at 220° to 260° C. for 60 minutes to obtain flame resistant fibers with a density of 1.35 g/cm³. When the flame resisting treatment was effected, 15% stretching was carried out on the fibers.

Then, the flame resistant fibers were passed through a first carbonization furnace having a temperature gradient of 300° to 600° C. in an atmosphere of pure $N_2$ while applying 8% stretch thereto.

Further, they were heat-treated for 2 minutes in a second carbonization furnace having a maximum temperature of 1,300° C. in the same atmosphere under a tension of 400 mg/denier.

Further, the thus obtained carbon fibers were heat-treated for 2 minutes in a graphitization furnace having a maximum temperature of 2,200° C. in the same atmosphere as that of the first carbonization furnace. The resultant carbon fibers had a strand strength of 450 kg/mm² and a strand modulus of 40.0 t/mm². Using the carbon fibers as anode, an electric current was passed in a first bath of a 5% aqueous phosphoric acid solution having a pH of 1 at 30° C., and then p-phenylenediamine (1.0% by weight) was added to a second bath of a 5% aqueous ammonium bicarbonate solution or a 5% aqueous sodium nitrate solution having a temperature of 30° C. and an electric current was passed through the second bath using the carbon fibers as anode. The quantity of the electricity was varied in the second electrolytic treatments. The treating speed in the treatments was 20 m/hour.

The results are shown in Table 3. The results of Comparative Examples are also shown in Table 3.

TABLE 3

| No | First surface oxidation treatment: Electrolytic solution | First surface oxidation treatment: Quantity of electricity (coulombs/g) | First surface oxidation treatment: O/C | Second surface oxidation treatment: Electrolytic solution | Second surface oxidation treatment: Quantity of electricity (coulombs/g) | $i_{pa}$ (μA/cm²) | O/C | N/C | τ (kg/mm²) |
|---|---|---|---|---|---|---|---|---|---|
| Example 14 | Phosphoric acid (5 wt %) (30° C.) | 60 | 0.22 | Ammonium bicarbonate (5 wt %) p-phenylenediamine (1 wt %) (30° C.) | 220 | 0.94 | 0.16 | 0.10 | 5.0 |
| Example 15 | Phosphoric acid (5 wt %) (30° C.) | 60 | 0.22 | Ammonium bicarbonate (5 wt %) p-phenylenediamine (1 wt %) (30° C.) | 440 | 0.75 | 0.15 | 0.09 | 5.1 |
| Example 16 | Phosphoric acid (5 wt %) (30° C.) | 60 | 0.22 | Sodium nitrate (5 wt %) p-phenylenediamine (1 wt %) (30° C.) | 330 | 2.13 | 0.25 | 0.08 | 3.4 |
| Example 17 | Phosphoric acid (5 wt %) (30° C.) | 60 | 0.22 | Sodium nitrate (5 wt %) p-phenylenediamine (1 wt %) (30° C.) | 660 | 2.00 | 0.27 | 0.08 | 3.2 |
| Comparative Example 11 | Phosphoric acid (5 wt %) (30° C.) | 60 | 0.22 | Without | — | 0.63 | 0.22 | Undetectable | 2.5 |
| Example 18 | Phosphoric acid (5 wt %) (30° C.) | 60 | 0.22 | Ammonium bicarbonate (5 wt %) p-phenylenediamine (1 wt %) (30° C.) | 65 | 0.58 | 0.19 | Undetectable | 2.4 |
| Example 19 | Phosphoric acid (5 wt %) (30° C.) | 60 | 0.22 | Sodium nitrate (5 wt %) p-phenylenediamine (1 wt %) (30° C.) | 65 | 1.21 | 0.28 | Undetectable | 2.3 |
| Comparative Example 12 | Without | 60 | — | Without | — | 0.006 | 0.06 | Undetectable | 0.7 |

EXAMPLES 20 TO 26 AND COMPARATIVE EXAMPLES 13 TO 14

Example 14 was repeated, except that the maximum temperature of the graphitization furnace was 2,500° C. The carbon fibers thus obtained had a strand strength of 360 kg/mm² and a strand modulus of 46.0 t/mm². The same electrolytic treatments as in Example 14 were carried out for the resultant high-modulus carbon fibers. The quantity of the electricity was varied in the second electrolytic treatment.

The results are shown in Table 4. The results of Comparative Examples are also shown in Table 4.

effected on the resultant filaments in warm water followed by washing with water and drying, and then further 1.7 times stretch was effected on the filaments under dry condition at 170° C. to obtain a precursor having 12,000 filaments of 0.9 deniers.

TABLE 4

| | First surface oxidation treatment | | | Second electrolytic treatment | | | | | |
|---|---|---|---|---|---|---|---|---|---|
| No. | Electrolytic solution | Quantity of electricity (coulombs/g) | O/C | Electrolytic solution | Quantity of electricity (coulombs/g) | $i_{pa}$ ($\mu A/cm^2$) | O/C | N/C | $\tau$ ($kg/mm^2$) |
| Example 20 | Phosphoric acid (5 wt %) | 60 | 0.27 | Ammonium bicarbonate (5 wt %) p-phenylenediamine (1 wt %) (30° C.) | 220 | 1.15 | 0.17 | 0.06 | 4.0 |
| Example 21 | Phosphoric acid (5 wt %) | 60 | 0.27 | Ammonium bicarbonate (5 wt %) p-phenylenediamine (1 wt %) (30° C.) | 440 | 1.26 | 0.18 | 0.08 | 4.6 |
| Example 22 | Phosphoric acid (5 wt %) | 60 | 0.27 | Ammonium bicarbonate (5 wt %) p-phenylenediamine (1 wt %) (30° C.) | 650 | 0.95 | 0.16 | 0.09 | 5.2 |
| Example 23 | Phosphoric acid (5 wt %) | 60 | 0.27 | Sodium nitrate (5 wt %) p-phenylenediamine (1 wt %) (30° C.) | 330 | 3.20 | 0.25 | 0.07 | 3.6 |
| Example 24 | Phosphoric acid (5 wt %) | 60 | 0.27 | Sodium nitrate (5 wt %) p-phenylenediamine (1 wt %) (30° C.) | 660 | 2.87 | 0.26 | 0.07 | 3.4 |
| Comparative Example 13 | Phosphoric acid (5 wt %) | 60 | 0.27 | Without | — | 0.69 | 0.27 | Undetectable | 2.5 |
| Example 25 | Phosphoric acid (5 wt %) | 60 | 0.27 | Ammonium bicarbonate (5 wt %) p-phenylenediamine (1 wt %) (30° C.) | 65 | 0.72 | 0.25 | 0.02 | 2.3 |
| Example 26 | Phosphoric acid (5 wt %) | 60 | 0.27 | Sodium nitrate (5 wt %) p-phenylenediamine (1 wt %) (30° C.) | 65 | 0.90 | 0.28 | Undetectable | 2.4 |
| Comparative Example 14 | Without | — | — | Without | — | 0.03 | 0.05 | Undetectable | 0.5 |

EXAMPLE 27 AND COMPARATIVE EXAMPLE 15

The same electrolytic treatments as in Example 20 were carried out using a bundle of Carbon Fiber HS 40 manufactured by Mitsubishi Rayon Co., Ltd. and having a strand strength of 400 $kg/mm^2$, and a modulus of 46 $t/mm^2$ that had not been subjected to an oxidation treatment.

The $\tau$ and ILSS using the resultant carbon fibers were measured. The results are shown in Table 5. The results of Comparative Example are also shown in Table 5.

The precursor was passed through a hot-air circulating type furnace at 220° to 260° C. for 60 minutes to obtain flame resistant fibers with a density of 1.35 $g/cm^3$. When the flame resisting treatment was effected, 15% stretching was carried out on the fibers.

Then, the flame resistant fibers were passed through a first carbonization furnace having a temperature gradient of 300° to 600° C. in an atmosphere of pure $N_2$ while applying 8% stretch thereto.

Further, they were heat-treated for 2 minutes in a second carbonization furnace having a maximum temperature of 2,500° C. in the same atmosphere as in the first carbonization furnace under a tension of 400 mg/denier to obtain carbon fibers. The resultant carbon fibers had a strand strength of 360 $kg/mm^2$ and a strand modulus of 46.0 $t/mm^2$. Using the carbon fibers as anode, an electric current was passed in a first bath of a 5% aqueous phosphoric acid solution having a pH of 1° at 30° C. with the quantity of electricity for the treatment being 55 coulombs/g.

TABLE 5

| | First surface oxidation treatment | | Second surface oxidation treatment | | | |
|---|---|---|---|---|---|---|
| No. | Electrolytic solution | Quantity of electricity (coulombs/g) | Electrolytic solution | Quantity of electricity (coulombs/g) | $\tau$ ($kg/mm^2$) | ILSS ($kg/mm^2$) |
| Example 27 | Phosphoric acid (5 wt %) | 60 | Ammonium bicarbonate (5 wt %) p-phenylenediamine (1 wt %) | 220 | 4.3 | 9.5 |
| Comparative Example 15 | Phosphoric acid (5 wt %) | 60 | Without | — | 2.3 | 8.0 |

EXAMPLES 28 TO 32

An acrylonitrile/methacrylic acid copolymer (weight ratio: 98 / 2) was dissolved in dimethylformamide to prepare a dope with solid concentration of 26% by weight. The dope was subjected to filtrations with filters of 10-$\mu$m and 3-$\mu$m pore size, rspectively, and subjected to wet spinning, then 4.5 times stretch was Then, 1.0 to 3.0% by weight of an aromatic compound having one or more hydroxyl groups were added to a second bath of a 5% aqueous ammonium bicarbonate solution having a pH of 7.5 at a temperature of 30° C., and an electric current was passed through the second bath using the carbon fibers as anode under the conditions as shown in Table 6. The treating speed in the treatments was 20 m/hour. After the treatment of electrolytic treatment through the phosphoric acid solution, the oxygen functional group content ($O_{1S}/C_{1S}$) was 0.27.

The results are shown in Table 6.

TABLE 6

| No | Monomer | Monomer concentration (%) | Quantity of electricity used for treatment (coulombs/g) | Interfacial shear strength (τ) (kg/mm²) |
|---|---|---|---|---|
| Example 28 | Phenol | 3.0 | 55 | 3.5 |
| Example 29 | Phenol | 3.0 | 440 | 5.1 |
| Example 30 | Resorcinol | 1.0 | 100 | 4.2 |
| Example 31 | Resorcinol | 1.0 | 440 | 3.9 |
| Example 32 | Pyrocatechol | 1.0 | 110 | 2.7 |

Note
Electrolytic solution: aqueous ammonium bicarbonate solution (5%) (30° C.)
Carbon fibers: anode

EXAMPLES 33 TO 38

In the same manner as in Example 28, carbon fibers were obtained which had a strand strength of 360 kg/mm² and a strand modulus of 46.0 t/mm². Using the carbon fibers as anode, an electric current was passed in a first bath of a 5% aqueous phosphoric acid solution having a pH of 1 at 30° C. with the quantity of electricity for the treatment being 55 coulombs/g.

Then, 0.25 to 1.0% by weight of an aromatic compound having one or more hydroxyl groups and one or more amino groups was added to a second bath of a 5% aqueous ammonium bicarbonate solution having a pH of 7.5 at a temperature of 30° C., and an electric current was passed through the solution using the carbon fibers as anode under the conditions as shown in Table 7. The treating speed in the treatments was 20 m/hour. The results are shown in Table 7.

TABLE 7

| No. | Monomer | Monomer concentration (%) | Quantity of electricity used for treatment (coulombs/g) | Interfacial shear strength (τ) (kg/mm²) |
|---|---|---|---|---|
| Example 33 | m-aminophenol | 1.0 | 55 | 5.5 |
| Example 34 | m-aminophenol | 1.0 | 220 | 5.5 |
| Example 35 | m-aminophenol | 1.0 | 440 | 4.7 |
| Example 36 | o-aminophenol | 1.0 | 440 | 2.7 |
| Example 37 | p-aminosalicylic acid | 0.25 | 110 | 3.7 |
| Example 38 | p-aminosalicylic acid | 0.25 | 220 | 3.6 |

TABLE 7-continued

Note
Electrolytic solution: aqueous ammonium bicarbonate solution (5%) (30° C.)
Carbon fibers: anode

EXAMPLES 39 AND 40 AND COMPARATIVE EXAMPLES 16 TO 18

In the same manner as in Example 28, carbon fibers were obtained which had a strand strength of 360 kg/mm² and a strand modulus of 46.0 t/mm². The carbon fibers were treated as follows:

Carbon fibers (Comparative Examples 16 and 17) were subjected to an electrolytic oxidation treatment in an aqueous phosphoric acid solution (5%);

Carbon fibers (Comparative Example 18) were not subjected to a surface treatment;

Carbon fibers (Example 39) were subjected to an electrolytic treatment (as anode) in an aqueous solution of 5% by weight of ammonium bicarbonate and 3% by weight of phenol without subjecting to an electrolytic oxidation treatment in an aqueous solution of 5% phosphoric acid (the oxygen functional group content $O_{1S}/C_{1S}$ of the fibers Was 0.05 before the electrolytic treatment.); and Carbon fibers (Example 40) were subjected to an electrolytic treatment (as anode) in an aqueous solution of 5% by weight of ammonium bicarbonate and 1% by weight of m-aminophenol without subjecting to an electrolytic oxidation treatment in an aqueous solution of 5% by weight of phosphoric acid. The interfacial shear strength of these carbon fibers was measured. The results are shown in Table 8. From these results, it can be understood that without subjecting the carbon fibers to a surface treatment under the conditions of the present invention, carbon fibers excellent in adhesion to epoxy resins could not be obtained.

TABLE 8

| No. | Surface treatment | Quantity of electricity used for treatment (coulombs/g) | Interfacial shear strength (τ) (kg/mm²) |
|---|---|---|---|
| Comparative Example 16 | Electrolytic oxidation treatment* | 22 | 1.8 |
| Comparative Example 17 | Electrolytic oxidation treatment* | 55 | 2.1 |
| Comparative Example 18 | Untreated | — | 0.5 |
| Example 39 | Electrolytic treatment** | 440 | 1.4 |
| Example 40 | Electrolytic treatment*** | 440 | 1.4 |

*Aqueous phosphoric acid solution (5%) (30° C.)
**Carbon fibers of 0.05 of $O_{1S}/C_{1S}$ were subjected to an electrolytic treatment in an aqueous solution of ammonium bicarbonate (5%) and phenol (3%).
***Carbon fibers of 0.05 of $O_{1S}/C_{1S}$ were subjected to an electrolytic treatment in an aqueous solution of ammonium bicarbonate (5%) and p-aminophenol (1%).

EXAMPLES 41 TO 47

An acrylonitrile/methacrylic acid copolymer (weight ratio: 98 / 2) was dissolved in dimethylformamide to prepare a dope with solid concentration of 26% by weight. The dope was subjected to filtrations with filters of 10-μm and 3-μm pore size, respectively, and subjected to wet spinning, then 4.5 times stretch was effected on the resultant filaments in warm water, followed by washing with water and drying, and then further 1.7 times stretch was effected on the filaments under dry condition at 170° C. to obtain a precursor having 12,000 filaments of 0.9 deniers.

The precursor was passed through a hot-air circulating type furnace at 220° to 260° C. for 60 minutes to obtain flame resistant fibers with a density of 1.35 g/cm$^3$. When the flame resisting treatment was effected, 15% stretching was carried out on the fibers.

Then, the flame resistant fibers were passed through a first carbonization furnace having a temperature gradient of 300° to 600° C. in an atmosphere of pure $N_2$ while applying 8% stretch thereto.

Further, they were heat-treated for 2 minutes in a second carbonization furnace having a maximum temperature of 1,800° C. in the same atmosphere as in the first carbonization furnace under a tension of 400 mg/denier to obtain carbon fibers. The carbon fibers had a strand strength of 550 kg/mm$^2$ and a strand modulus of 34.8 t/mm$^2$.

Using the carbon fibers as anode, they were subjected to an electrolytic treatment under conditions as shown in Table 9 in an aqueous solution containing 5% by weight of ammonium bicarbonate and having a pH of 7.5 at 30° C. to which 1 to 3% by weight of an aromatic compound having one or more hydroxyl groups and/or one or more amino groups is added. The treating speed in the treatments was 20 m/hour. The results are shown in Table 9.

TABLE 9

| No | Type and concentration of monomer (wt %) | Quantity of electricity used for treatment (coulombs/g) | Interfacial shear strength (τ) (kg/mm$^2$) |
|---|---|---|---|
| Example 41 | Phenol 3 | 460 | 3.4 |
| Example 42 | m-dihydroxybenzene 1 | 460 | 3.1 |
| Example 43 | Anyline 1 | 460 | 3.4 |
| Example 44 | p-phenylenediamine 1 | 230 | 3.2 |
| Example 45 | p-phenylenediamine 1 | 460 | 3.5 |
| Example 46 | m-aminophenol 1 | 230 | 3.3 |
| Example 47 | m-aminophenol 1 | 460 | 3.7 |

EXAMPLES 48 TO 51 AND COMPARATIVE EXAMPLES 19 TO 22

Carbon filters obtained in the same manner as in Example 29 were used as anode and were subjected to an electrolytic treatment under conditions as shown in Table 10. The results are shown in Table 10.

TABLE 10

| No. | Electrolytic solution | Quantity of electricity used for treatment (coulombs/g) | Interfacial shear strength (kg/mm$^2$) |
|---|---|---|---|
| Comparative Example 19 | Without | — | 1.1 |
| Comparative Example 20 | Ammonium bicarbonate (5%) | 200 | 2.9 |
| Comparative Example 21 | Phosphoric acid (5%) | 22 | 2.5 |
| Comparative Example 22 | Phosphoric acid (5%) | 100 | 2.0 |
| Example 48 | Sodium nitrate (5%), p-phenylenediamine (1%) | 22 | 2.0 |
| Example 49 | Sodium nitrate (5%), p-phenylenediamine (1%) | 200 | 2.4 |
| Example 50 | Sodium nitrate (5%), m-aminophenol (1%) | 22 | 2.1 |
| Example 51 | Sodium nitrate (5%), m-aminophenol (1%) | 200 | 2.7 |

Note
Temperature of electrolytic solution, 30° C.

EXAMPLES 52 TO 57

In the same manner as in Example 41, after passing flame resistant fibers through a first carbonization furnace, the fibers were heat-treated for 2 minutes by passing them through a second carbonization furnace having a maximum temperature of 2,500° C. in a pure $N_2$ atmosphere under a tension of 400 mg/denier to obtain carbon fibers that had a strand strength of 360 kg/mm$^2$ and a strand modulus of 46.0 t/mm$^2$.

Using the carbon fibers as anode, they were subjected to an electrolytic treatment under conditions as shown in Table 11 in an aqueous solution containing 5 % by weight of sodium nitrate at 30° C. to which 1 to 3% by weight of an aromatic compound having one or more of hydroxyl groups and/or one or more of amino groups is added. The treating speed in the treatments was 20 m/hour. The results are shown in Table 11.

EXAMPLES 58 TO 60 AND COMPARATIVE EXAMPLES 23 TO 25

Carbon fibers obtained in the same manner as in Example 41 were used as anode, and were subjected to an electrolytic treatment under treating conditions as shown in Table 12. The results are shown in Table 12.

TABLE 11

| No. | Type and concentration of monomer (wt %) | Quantity of electricity used for treatment (coulombs/g) | Interfacial shear strength (kg/mm$^2$) |
|---|---|---|---|
| Example 52 | Phenol 3 | 440 | 2.9 |
| Example 53 | m-dihydroxybenzene 1 | 440 | 2.6 |
| Example 54 | Anyline 1 | 440 | 3.0 |
| Example 55 | p-phenylenediamine 1 | 330 | 2.9 |
| Example 56 | p-phenylenediamine 1 | 660 | 2.8 |
| Example 57 | m-aminophenol 1 | 440 | 3.2 |

TABLE 12

| No. | Electrolytic solution | Quantity of electricity used for treatment (coulombs/g) | Interfacial shear strength (kg/mm$^2$) |
|---|---|---|---|
| Comparative Example 23 | Without | — | 0.5 |
| Comparative Example 24 | Phosphoric acid (5%) | 55 | 2.1 |
| Comparative | Phosphoric acid | 100 | 2.1 |

TABLE 12-continued

| No | Electrolytic solution | Quantity of electricity used for treatment (coulombs/g) | Interfacial shear strength (kg/mm²) |
|---|---|---|---|
| Example 25 | (5%) | | |
| Example 58 | Ammonium bicarbonate (5%), phenol (3%) | 440 | 1.4 |
| Example 59 | Ammonium bicarbonate (5%), p-phenylenediamine (1%) | 330 | 1.2 |
| Example 60 | Ammonium bicarbonate (5%), m-aminophenol (1%) | 440 | 1.4 |

Note
Temperature of electrolytic solution 30° C

From these results, it can be understood that without the surface treatment under the conditions of the present invention, carbon fibers which are excellent in adhesion to epoxy resins can not be obtained.

What is claimed is:

1. In a process for producing carbon fibers having surfaces modified by electrolytic treatment wherein an electric current is passed between the carbon fibers and a counter electrode in a solution containing an electrolyte and an aromatic compound having at least one amino group, the improvement comprising:

subjecting the carbon fibers to a first electrolytic treatment in an electrolytic solution free of aromatic compound then subjecting the carbon fibers to a second electrolytic treatment in an electrolytic solution containing said aromatic compound.

2. In a process as claimed in claim 1, the improvement, wherein the aromatic compound having one or more amino groups is represented by the general formula:

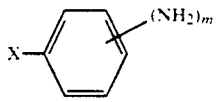

wherein X represents a hydrogen atom, an alkyl group, an aryl group, an alkoxy group, a carboxyl group, a vinyl group or an alkylene group having a carbon-carbon double bond, and m is a number of 1 to 4.

3. In a process as claimed in claim 1, the improvement, wherein the aromatic compound having one or more amino groups is represented by the general formula:

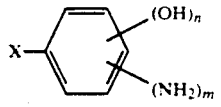

wherein X represents a hydrogen atom, an alkyl group, an aryl group, an alkoxy group, a carboxyl group, a vinyl group or an alkylene group having a carbon-carbon double bond, and m and n are a number of 1 to 4, respectively.

4. In a process as claimed in claim 1, the improvement, wherein the electrolytic treatment is carried out by using the carbon fibers as anode.

5. In a process as claimed in claim 1, the improvement, wherein the electrolytic treatment is carried out in an aqueous solution.

6. In a process as claimed in claim 1, wherein the concentration of the aromatic compound in the second solution is from 0.5 to 10% by weight.

7. In a process as claimed in claim 1, wherein the second solution is an aqueous solution containing an inorganic electrolyte.

8. In a process as claimed in claim 7, wherein the inorganic electrolyte is an ammonium salt of carbonic acid.

9. In a process as claimed in claim 1, wherein the first electrolytic treatment is conducted in an aqueous solution containing inorganic, acidic electrolyte or a neutral salt of electrolyte, and the second electrolytic treatment is carried out in an aqueous solution containing an alkali metal hydroxide, or ammonium salt of carbonic acid.

10. In a process as claimed in claim 1, wherein the quantity of the electricity used in the first electrolytic treatment is more than 5 coulombs/g, and the quantity of the electricity used in the second electrolytic treatment is more than 90 coulombs/g.

11. In a process as claimed in claim 1, the improvement, wherein said first or second electrolytic treatment is carried out under such conditions that carbon fibers having a modulus of lower than 40 t/mm² are used as an anode, in a medium selected from the group consisting of an aqueous solution of an inorganic alkali metal hydroxide or an ammonium salt of carbonic acid, each medium a pH of 7 or over.

12. In a process as claimed in claim 1, the improvement, wherein said first or second electrolytic treatment is carried out under such conditions that carbon fibers having a modulus of 40 t/mm² or over are used as an anode, in a medium selected from the group consisting of an aqueous solution of an inorganic, acidic electrolyte and an aqueous solution of a neutral salt electrolyte, each medium having a pH of 7 or lower.

13. In process as claimed in claim 1, the improvement, wherein the electrolytic treatment is carried out under such conditions that an electric current is passed between carbon fibers, which have been oxidized so that the oxygen content ($O_{1S}/C_{1S}$) of the carbon fiber surfaces determined by the X-ray photoelectron spectroscopy becomes 0.07 or over, and a counter electrode in a solution containing an aromatic compound having one or more of hydroxyl groups or amino groups.

14. In a process as claimed in claim 1, the improvement, wherein the carbon fibers are subjected to a first electrolytic treatment using the carbon fibers as an anode in a medium selected from the group consisting of an aqueous solution of an inorganic, acidic electrolyte and an aqueous solution of a neutral salt electrolyte having a pH of 7 or below so that the oxygen content ($O_{1S}/C_{1S}$) of the carbon fiber surfaces determined by the X-ray photoelectron spectroscopy becomes 0.07 or over, and further subjected to electrolytic treatment by passing electric current between the carbon fibers and a counter electrode in a medium containing an aromatic compound having one or more amino groups, and selected from the group consisting of an aqueous solution of an inorganic alkali metal hydroxide or ammonium salt of carbonic acid having a pH of 7 or over.

15. Carbon fibers which surfaces have been modified according to claim 1 and which have an interfacial shear strength () of 3.6 kg/mm² or over measured by the single filament adhesion test using an epoxy resin.

16. The carbon fibers as claimed in claim 15, in which the modulus of the fibers is lower than 40 t/mm$^2$, the $i_{pa}$ value determined by the electrochemical determination method (cyclic voltammetry) is in the range of 0.6 to 1.4 $\mu$A/cm$^2$, and the oxygen functional group content ($O_{1S}/C_{1S}$) and the nitrogen functional group content ($N_{1S}/c_{1S}$) of the carbon fiber surfaces determined by the X-ray photoelectron spectroscopy are in the ranges of 0.10 to 0.24, and 0.03 to 0.20, respectively.

17. The carbon fibers as claimed in claim 15, in which the modulus of the fibers is 40 t/mm$^2$ or over, the $i_{pa}$ value determined by the electrochemical determination method (cyclic voltammetry) is in the range of 0.8 to 3.5 $\mu$A/cm$^2$, and the oxygen functional group content ($O_{1S}/C_{1S}$) and the nitrogen functional group content ($N_{1S}/C_{1S}$) of the carbon fiber surfaces determined by the X-ray photoelectron spectroscopy are in the ranges of 0.10 to 0.30, and 0.03 to 0.25, respectively.

18. A carbon fiber composite comprising a matrix resin and carbon fibers produced by the process claimed in claim 1.

19. A carbon fiber composite comprising a matrix resin and carbon fibers claimed in claim 15.

* * * * *